US010711404B2

(12) United States Patent
Sundblad et al.

(10) Patent No.: US 10,711,404 B2
(45) Date of Patent: Jul. 14, 2020

(54) PULP MOLDING APPARATUS AND MOLDS FOR USE THEREIN

(71) Applicant: OrganoClick AB, Täby (SE)

(72) Inventors: Per Sundblad, Göteborg (SE); Torbjörn Hansson, Vallentuna (SE); Tommy Ollevik, Segeltorp (SE)

(73) Assignee: ORGANOCLICK AB, Täby (SE)

( * ) Notice: Subject to any disclaimer, the term of this patent is extended or adjusted under 35 U.S.C. 154(b) by 10 days.

(21) Appl. No.: 15/738,733

(22) PCT Filed: Jun. 23, 2016

(86) PCT No.: PCT/SE2016/050626
§ 371 (c)(1),
(2) Date: Dec. 21, 2017

(87) PCT Pub. No.: WO2016/209157
PCT Pub. Date: Dec. 29, 2016

(65) Prior Publication Data

US 2018/0187379 A1 Jul. 5, 2018

(30) Foreign Application Priority Data

Jun. 23, 2015 (SE) ..... 1550864

(51) Int. Cl.
*D21J 1/04* (2006.01)
*D21J 7/00* (2006.01)
*D21J 3/00* (2006.01)

(52) U.S. Cl.
CPC . *D21J 1/04* (2013.01); *D21J 3/00* (2013.01); *D21J 7/00* (2013.01)

(58) Field of Classification Search
CPC ..... D21J 7/00; D21J 3/00; D21J 1/04; D21J 3/10; D21J 5/00; B31B 50/59; Y10S 425/044
See application file for complete search history.

(56) References Cited

U.S. PATENT DOCUMENTS 293,220 A 2/1884 Bodge
528,612 A 11/1894 Shaw
(Continued)

FOREIGN PATENT DOCUMENTS

CN 1274029 A 11/2000
CN 1827485 A 9/2006
(Continued)

OTHER PUBLICATIONS

Swedish Office Action dated Jan. 22, 2016 for Swedish Application No. 1550864-1.

(Continued)

*Primary Examiner* — Jose A Fortuna
(74) *Attorney, Agent, or Firm* — Faegre Drinker Biddle & Reath LLP

(57) ABSTRACT

Press for making large molded pulp objects, which has a raisable and lowerable male mold half, perforated for suction dewatering after dipping into a pulp slurry. The molding surface of said male mold half is coated with an elastomer to preserve even surface contact with the molded pulp object during compression and during thermal expansion or contraction of said mold halves. Advantageous embodiments include vacuum distribution troughs beneath the elastomer layer in the male mold half, multiple wire mesh layers on top of the perforated elastomer layer, and slight lateral adjustability of the otherwise stationary female mold half.

11 Claims, 11 Drawing Sheets

(56) References Cited

U.S. PATENT DOCUMENTS

| | | | | |
|---|---|---|---|---|
| 1,551,257 | A | 8/1925 | Little | |
| 2,518,164 | A | 8/1950 | Meyer | |
| 3,250,668 | A * | 5/1966 | Modersohn | D21J 7/00 162/220 |
| 4,014,739 | A * | 3/1977 | Granberg | D21J 7/00 162/274 |
| 4,034,447 | A | 7/1977 | Kollmann et al. | |
| 4,162,935 | A | 7/1979 | Kollmann et al. | |
| 5,272,852 | A | 12/1993 | Fortin et al. | |
| 5,603,808 | A * | 2/1997 | Nishikawa | D21J 7/00 162/382 |
| 5,656,135 | A * | 8/1997 | Baker | D21J 5/00 162/388 |
| 5,771,549 | A | 6/1998 | Saaf | |
| 6,149,845 | A | 11/2000 | Ren | |
| 6,245,199 | B1 | 6/2001 | Lee | |
| 6,421,957 | B1 | 7/2002 | Hasegawa et al. | |
| 8,151,421 | B2 | 4/2012 | Hsu et al. | |
| 2004/0013830 | A1 | 1/2004 | Nonomura et al. | |
| 2004/0084165 | A1 | 5/2004 | Shannon | |
| 2004/0084166 | A1* | 5/2004 | Nonomura | B29C 57/12 162/218 |
| 2010/0075120 | A1 | 3/2010 | Gustafsson et al. | |
| 2012/0042488 | A1 | 2/2012 | Hsu et al. | |
| 2013/0112361 | A1 | 5/2013 | Mikami et al. | |
| 2018/0171561 | A1* | 6/2018 | Sundblad | B32B 29/08 |
| 2018/0177661 | A1* | 6/2018 | Sundblad | A61G 17/007 |
| 2018/0187379 | A1* | 7/2018 | Sundblad | D21J 3/00 |
| 2019/0169800 | A1* | 6/2019 | Hardacre | D21J 3/10 |

FOREIGN PATENT DOCUMENTS

| | | | |
|---|---|---|---|
| DE | 19922785 | A1 | 11/2000 |
| EP | 0466653 | A1 | 1/1992 |
| EP | 0719894 | A2 | 7/1996 |
| EP | 1085127 | A2 | 3/2001 |
| EP | 1197596 | A1 | 4/2002 |
| EP | 2 563 311 | A1 | 3/2013 |
| GB | 10669 | | 6/1894 |
| GB | 253179 | A | 6/1926 |
| GB | 2448592 | A | 10/2008 |
| JP | H09117480 | A | 5/1997 |
| JP | H09-195200 | | 7/1997 |
| JP | 2000-237251 | A | 9/2000 |
| JP | 2002-180400 | A | 6/2002 |
| KR | 20080103694 | A | 11/2008 |
| RU | 68831 | | 12/1947 |
| SE | 529897 | C2 | 12/2007 |
| WO | WO-98/11194 | A1 | 3/1998 |
| WO | WO99/22069 | A1 | 5/1999 |
| WO | WO-2006/016072 | A2 | 2/2006 |
| WO | WO-2011/134479 | A1 | 11/2011 |
| WO | WO-2018/037251 | A1 | 3/2018 |

OTHER PUBLICATIONS

Extended European search report dated Mar. 1, 2019 issued in European patent application No. 16814817.9.

Russian Office Action issued in Russian patent application No. 2017144082/05(075691) dated Aug. 21, 2019 (7 pages) and its English-language translation thereof (5 pages).

Extended European search report issued in European patent application No. EP16814816.1, dated Mar. 26, 2019.

Database WPI, Week 200776, Thomson Scientific, London, GB; AN 2007-805856, XP002789575.

Anonymous: "Re-board, Boundless Imagination with Reboard", Re-board Technology, Mar. 8, 2019 (Mar. 8, 2019); CP002789576, retrieved from the internet: URL:https://reboard.se/re-board/ [retrieved on Mar. 8, 2019].

Swedish Office Action dated Feb. 1, 2016 for Swedish Application No. 1550866-6.

Swedish Office Action dated Feb. 1, 2016 for Swedish Application No. 1550867-4.

Extended European search report issued in European patent application No. 16 81 4818.7, dated Jan. 7, 2019.

U.S. Office Action dated Jan. 31, 2020 that issued in U.S. Appl. No. 15/738,802 including Double Patenting Rejections on pp. 2-4.

U.S. Office Action dated Nov. 15, 2019 that issued in U.S. Appl. No. 15/738,873 including Double-Patenting Rejections on pp. 2-4.

* cited by examiner

PULP MOLDING APPARATUS AND MOLDS FOR USE THEREIN

CROSS-REFERENCE TO PRIOR APPLICATION

This application is a § 371 National Stage Application of PCT International Application No. PCT/SE2016/050626 filed Jun. 23, 2016, which claims priority to Swedish Patent Application No. 1550864-1 filed Jun. 23, 2015, each of which are herein incorporated by reference in their entirety.

TECHNICAL FIELD

Generally, embodiments herein relate to molding of large pulp objects, the molds used therein and the apparatus for producing large objects of molded pulp using such molds.

More specifically, different embodiments of the application relate inter alia to different mold linings and in one non-limiting embodiment to the pulp molding of large objects such as coffins.

BACKGROUND

Pulp molding is known in the art for producing small packages such as egg cartons, disposable food dishes, box inserts and other protective packaging materials etc.

RELATED ART

U.S. Pat. No. 6,245,199 describes a method of pulp molding trays where the starting material is a suspension containing cellulose fibers. The male mold half is dipped in a bath of the suspension, and the mold halves are then pressed together under heat and pressure.

SE 529 897 C2 describes the pulp molding of a tray where a dewatering receptacle is used to shape a tray of pulp which is then transferred to a compression tool where the tray is subjected to pressure and heat. It involves a transfer step and is not readily usable for large containers.

However, none of the related art discloses or hints at how to achieve the solutions provided by embodiments herein.

OBJECT OF THE INVENTION

Embodiments herein intends to solve a complex of difficult-to-reconcile interrelated problems still present in the designs of the prior art:

Hitherto it has been very difficult to use existing pulp molding methods to produce very large objects. This is due partially to the problem of thermal expansion and contraction of the two metal mold halves used in the compression of the pulp in the press. If the dimensions of the mold halves change, due to unavoidably becoming cooler and hotter during the compression process, the strength of the container will be compromised and the surface will not be smooth and even. This is not a problem if the surface quality and the strength of the finished object is of no great importance, such as for packaging materials or disposable dishes, but where the strength and surface finish of the finished molded product is of great importance then this is a problem.

One such very large product, where strength and finish are of the utmost importance, are caskets, although the present solution is not limited thereto.

It would also be a great advantage if the production steps could be severely reduced in number and complexity.

In general it is difficult to achieve uniformity of strength and surface in pulp molded products, particularly in such products which are thin.

SUMMARY

This entire complex of problems listed above finds its solution in embodiments herein as defined in the appended main patent claim.

Various embodiments of the disclosure comprises a pair of mold halves 3, 5 suitable for pulp molding by compression and heating, comprising a first half 5 for application of a pulp slurry and a second conforming mold half 3, wherein the surface of said first half mold 5 is covered with an elastomeric material.

Further embodiments of the disclosure comprises:

A pair of mold halves wherein said first mold half 5 is a perforated 8 mold half suitable for suction dewatering of pulp.

A pair of mold halves wherein one or several layers of wire mesh 7 cover the elastomeric material 6 providing a suction dewatering surface for pulp.

A pair of mold halves wherein said elastomeric material 6 is adapted to absorb thermal contraction and expansion of said mold halves 3, 5 during compression of a molded pulp container.

A pair of mold halves wherein bodies of said mold halves 3, 5 are made of metal.

A pair of mold halves according to one of the preceding claims characterized in that said first half 5 is a male mold half and said second mold half 3 is a female mold half conforming to said male form half.

A pair of mold halves wherein said male mold half 5 has a hollow interior vacuum cavity 15 and multiple conduit pathways 8, 10 providing suction effect between said vacuum cavity 15 and the surface of said male mold half for suction dewatering of pulp.

A pair of mold halves wherein said male mold half is provided under said elastomer material 6 with troughs 14 in said body of said male mold half distributing vacuum effect under said elastomeric material 6.

A pair of mold halves wherein said elastomeric material 6 has a thickness of between 10 and 50 mm.

A pair of mold halves wherein said elastomeric material 6 has a hardness of ca. 60-80 Shore A.

A pair of mold halves wherein said elastomeric material 6 has a different hardness on the sides of the mold half than on the bottom thereof.

A pair of mold halves wherein the mold halves 3,5 are metal mold halves and/or the bodies of the mold halves 3,5 are made of metal.

A pair of mold halves wherein the surface of said first half mold 5 is covered by being spray coated or cast with an elastomeric material.

A pair of mold halves wherein said mold halves being metal mold halves 3, 5 suitable for pulp molding by compression and heating, comprising a first half (5) for application of a pulp slurry and a second conforming mold half 3, wherein the metal surface of said first half mold 5 is spray coated or cast with an elastomeric material.

A pair of mold halves wherein said male mold half is provided under said elastomer material 6 with troughs 14 in said body of said male mold half communicating between small dewatering holes 10 in the elastomer layer and holes 8, leading to a vacuum cavity 15 spaced in the bottoms of the troughs 14, for distributing vacuum effect under said elastomeric material 6.

Embodiments of the disclosure further comprises an apparatus for use together with a pair of mold halves as defined in embodiments of the disclosure, comprising, a frame 1 in which a first of said mold halves 5 is mounted in means for translational movement towards a second mold half 3, means for compressing and holding said pair 3,5 of mold halves fitted against each other and a bath 10 of pulp slurry, characterized in that said means 4 for translational movement are adapted for immersing a first mold half in said bath 16 of pulp slurry and moving said first mold half into fitting compression against said second mold half.

Further embodiments of the disclosure comprises:

An apparatus wherein said second mold half is mounted for slight horizontal movement, to achieve correct alignment during fitting compression of said first mold half 5 in said second mold half 3.

An apparatus wherein said second mold half is mounted for slight horizontal movement of at most 25 mm, to achieve correct alignment during fitting compression of said first mold half 5 in said second mold half 3.

BRIEF DESCRIPTION OF DRAWINGS

Embodiments herein will now be described in more detail with reference to the appended drawings, wherein:

FIG. 3(*b*) shows the same male mold half in perspective view.

DETAILED DESCRIPTION

Figure 1A:
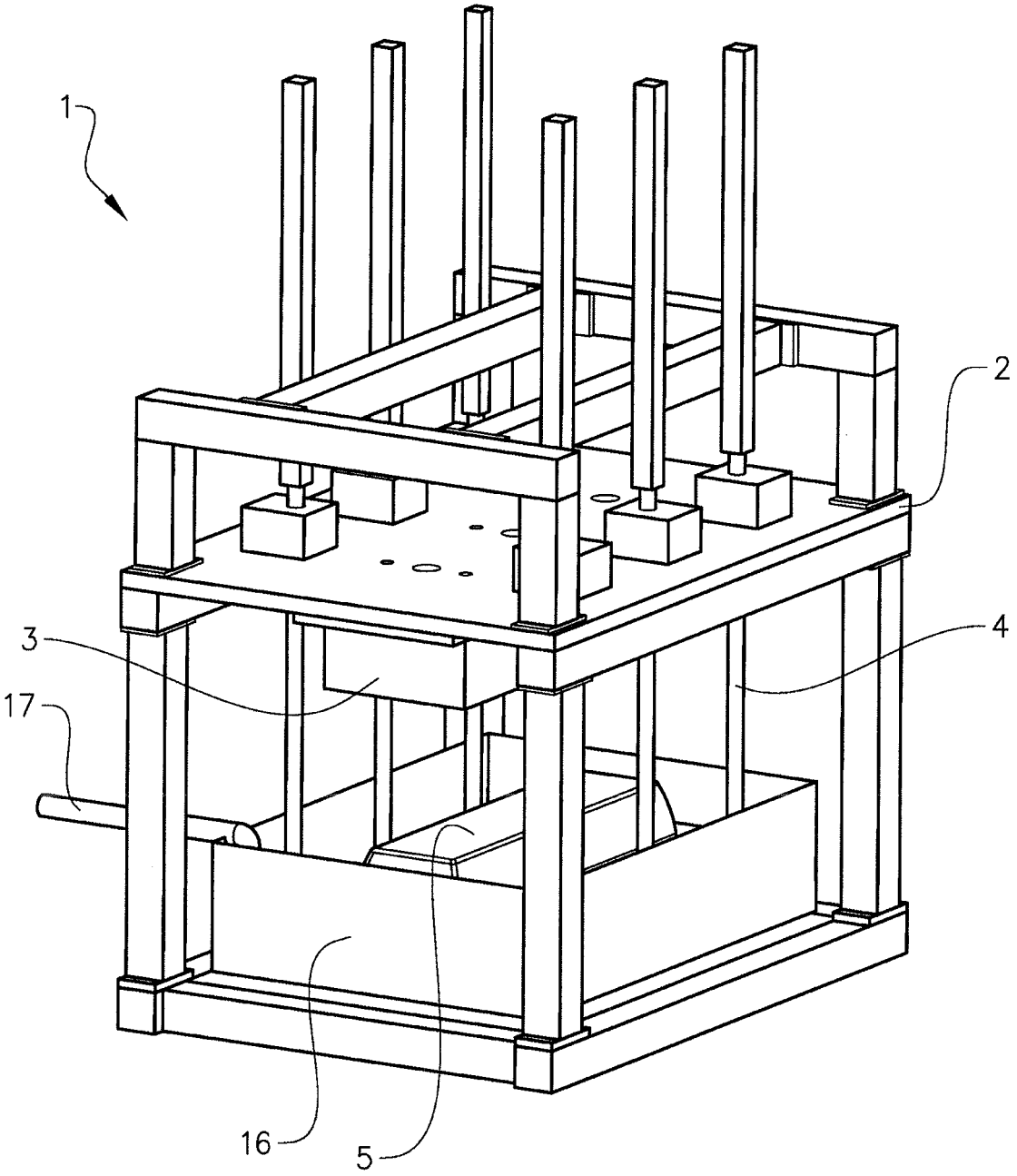
FIGS. 1(*a*)-1(*f*) shows an exemplary frame for use with a pair of mold halves according to embodiments herein, in various positions of the male mold half and in various sections to more clearly show how the components interact.
Figure 1B:
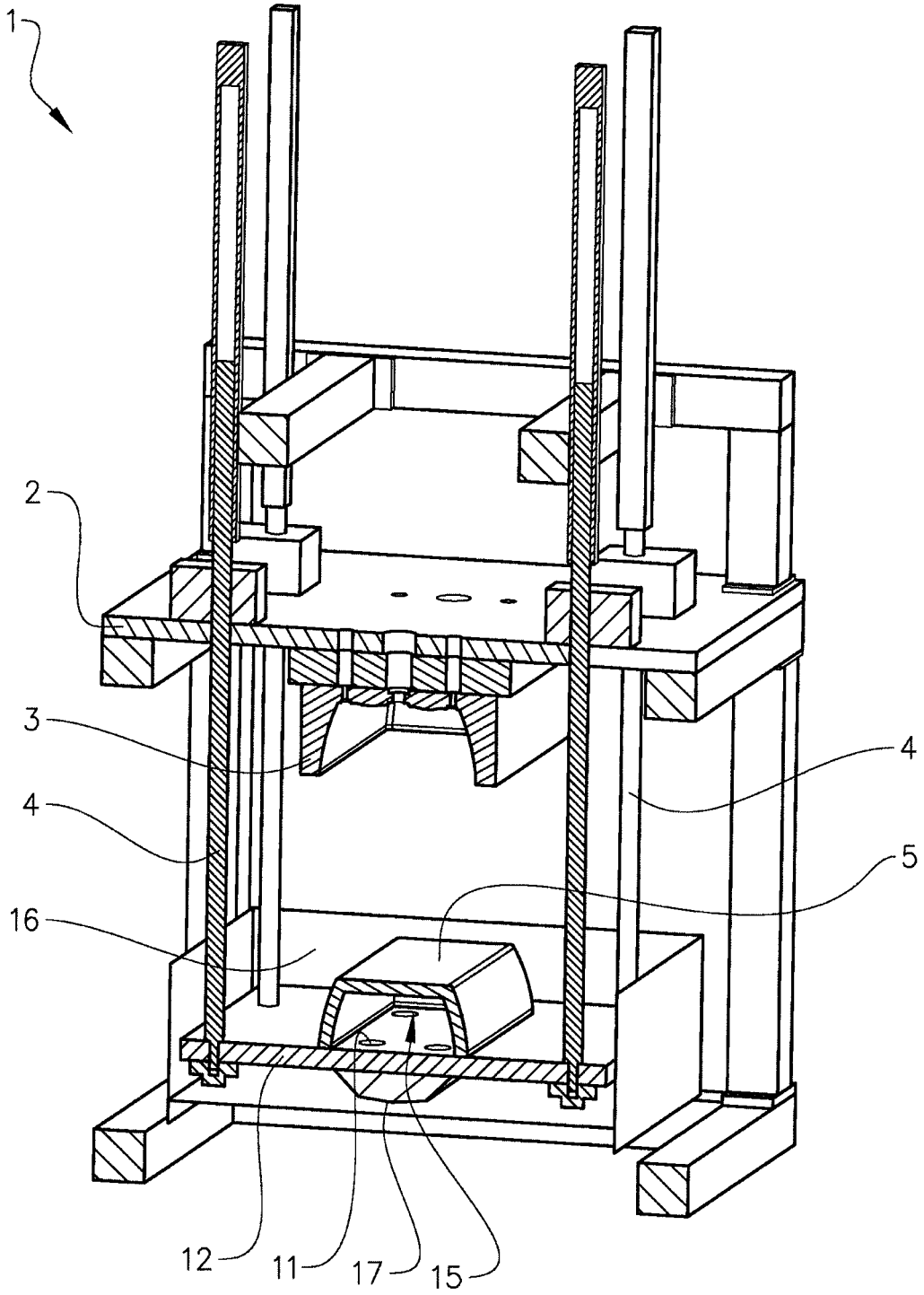
Figure 1C:
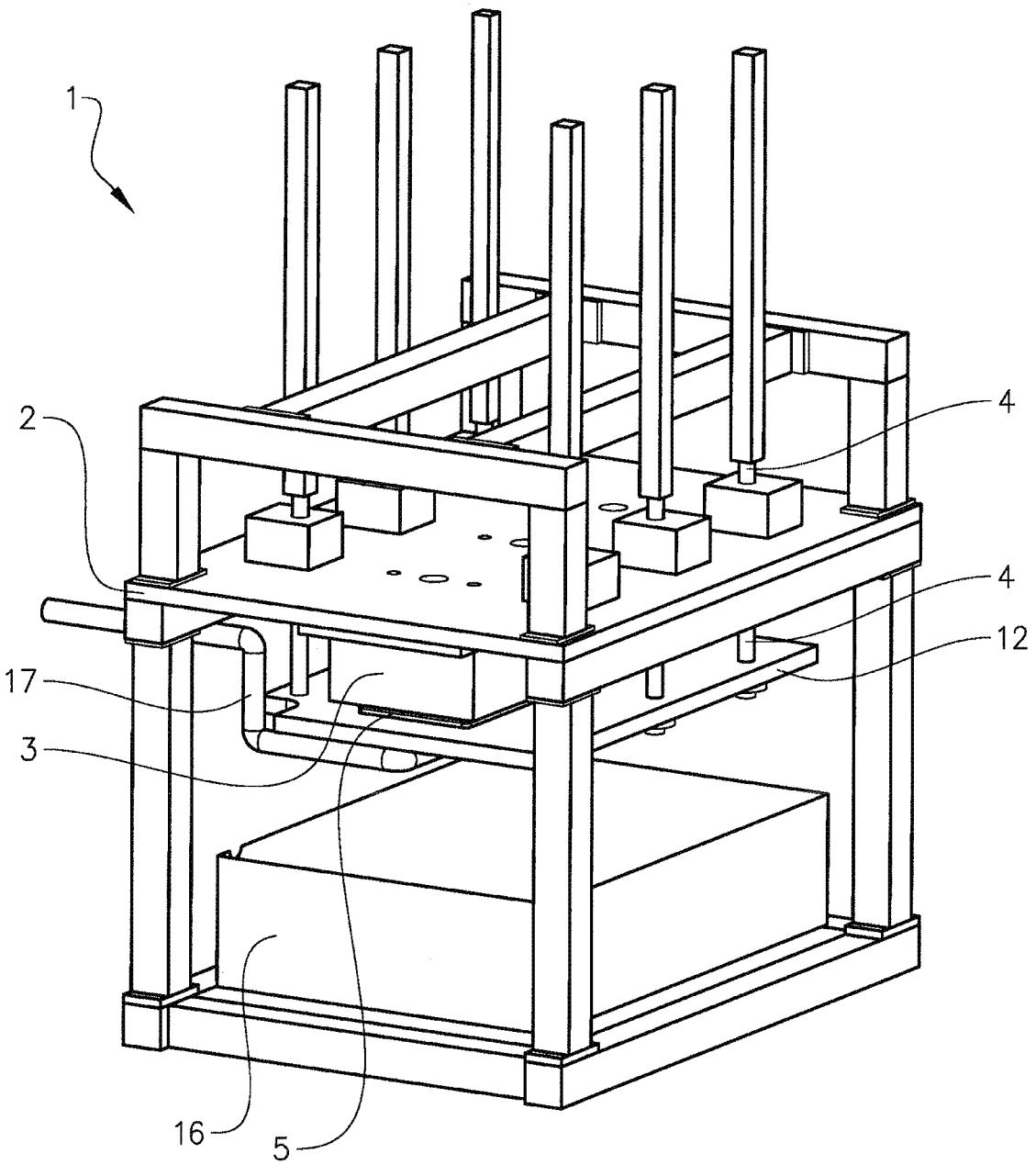
Figure 1D:
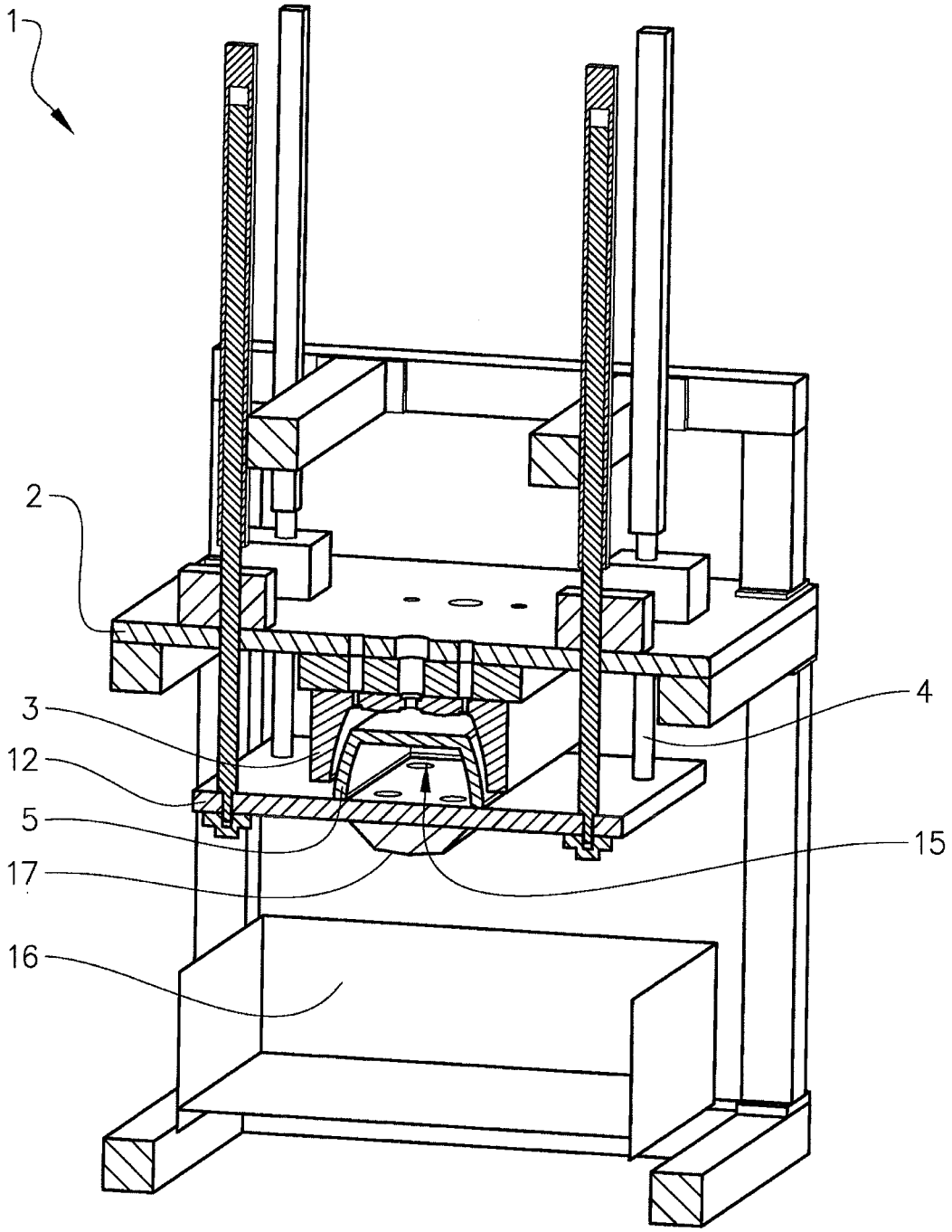
Figure 1E:
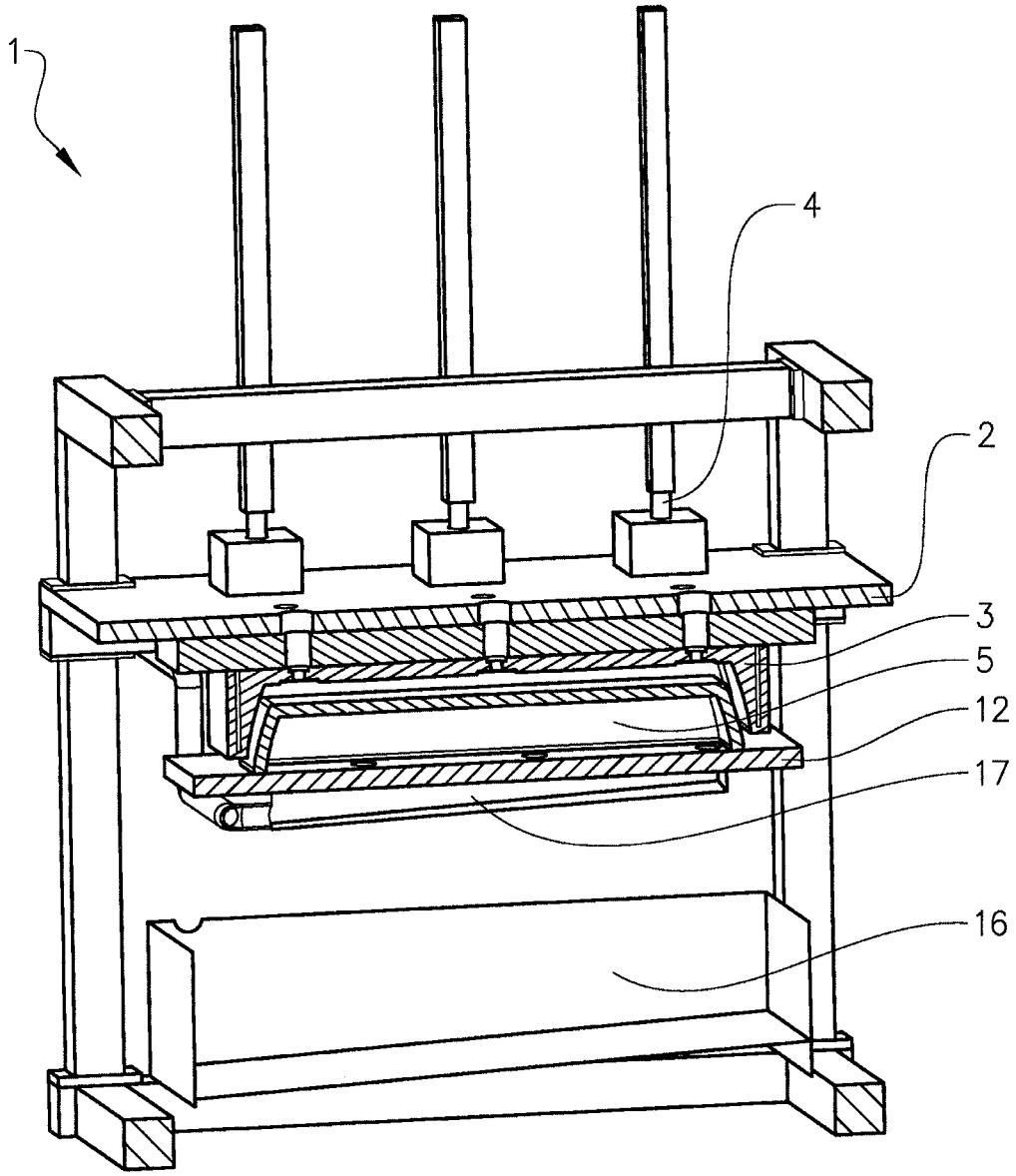
Figure 1F:
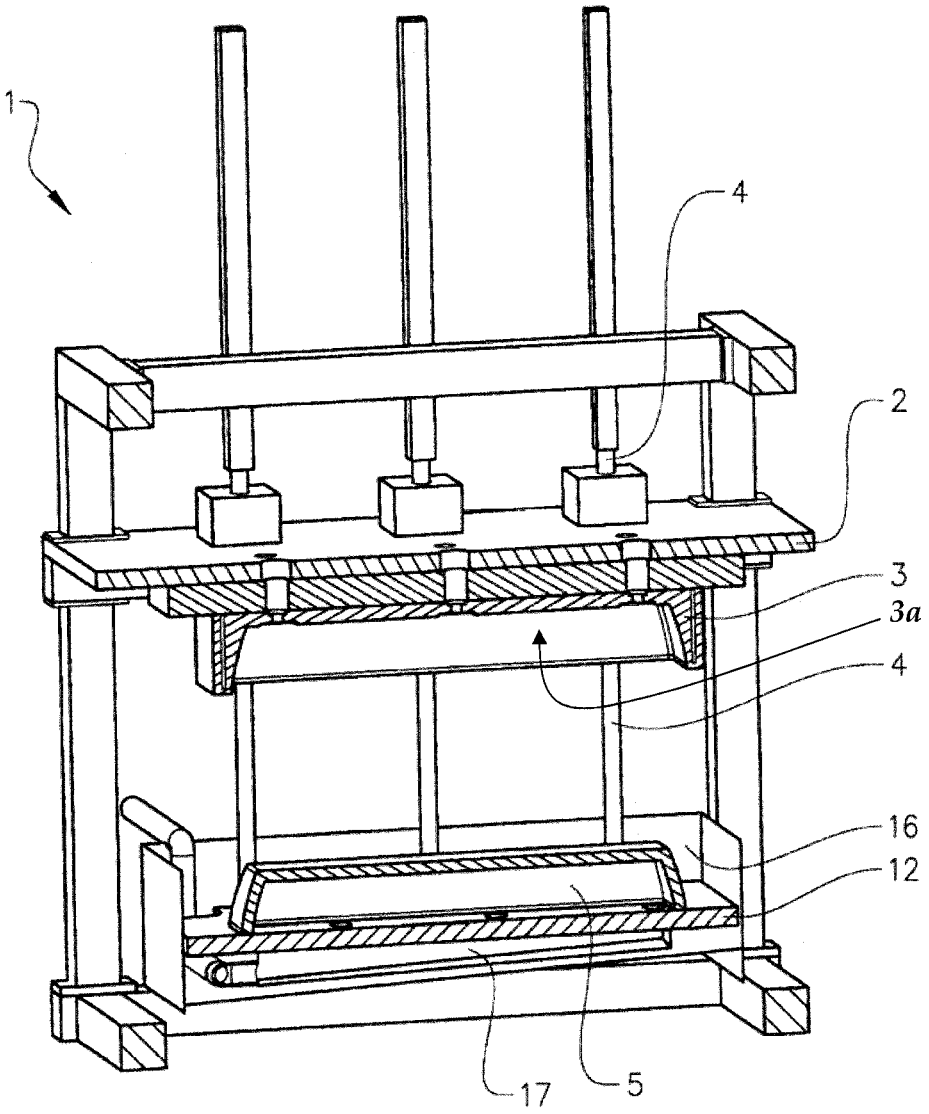

The apparatus according to embodiments herein as shown in one embodiment comprises a frame 1, holding a stationary platform 2 on which is mounted a female mold half 3 and below it a movable platform 12 holding a male mold half 5. FIGS. 1(*a*), 1(*b*) and 1(*f*) show the apparatus in its mold-separated position and FIGS. 1(*c*), 1(*d*) and 1(*e*) shown the apparatus its mold-compressed position for forming the molded pulp shell. The same reference numerals for the same components are used throughout all of the drawings. The apparatus of this embodiment is shown in FIG. 1(*a*) in perspective view in the mold-separated position with the male mold half 5 submerged in a slurry bath 16. The liquid slurry itself is not shown in the figure. This same mold-separated position is shown in vertical section in FIG. 1(*b*).

The male mold half 5 is submerged in a pulp slurry bath 16 (99.5% water and 0.5% pulp fibers at 25-30 degrees C.) and a suction system 17 is connected to the hollow interior cavity 15 of the male mold, as shown in FIG. 1(*b*), whereby a coating of pulp slurry is sucked onto the surface of the male mold half 5.

Six synchronously motor driven nuts on six long screw rods 4 move the male mold half 5 from the slurry bath 16 into pressure engagement with the female mold half 3, which is heated, in the compression position of the molds shown in FIGS. 1(*c*), 1(*d*) and 1(*e*).

Figure 2:
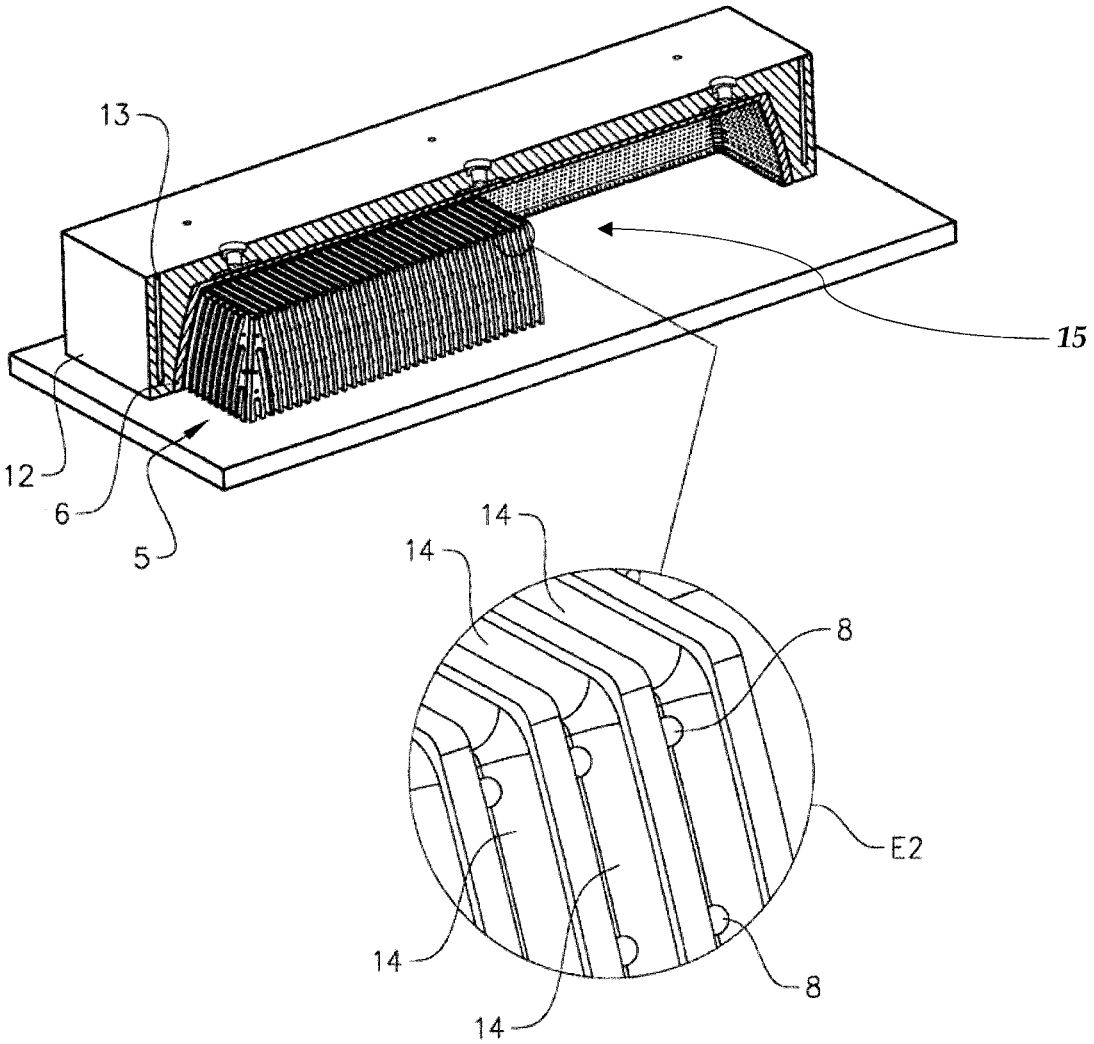
FIG. 2 shows in perspective the pair of mold halves engaged in an exemplary embodiment of embodiments herein.

FIG. 2 shows only the two mold halves in engagement with each other. In embodiments one or both of the mold halves or the bodies of the mold halves may be made of metal. The female mold half 3 of massive aluminum is shown in longitudinal section, while only half of the length of the male mold half 5 is shown. The elastomer 6 covering the entire surface of the male mold half 5 is shown in longitudinal section only to reveal the structure of the male mold half 5 which is covered with troughs 14 for optimal even distribution of the vacuum suction while it drains the pulp of water. The detailed enlargement E2 shows more clearly these vacuum distribution troughs 14 and the holes 8 in the bottoms thereof leading to the vacuum cavity 15 within the male mold half 5.

Figure 3A:
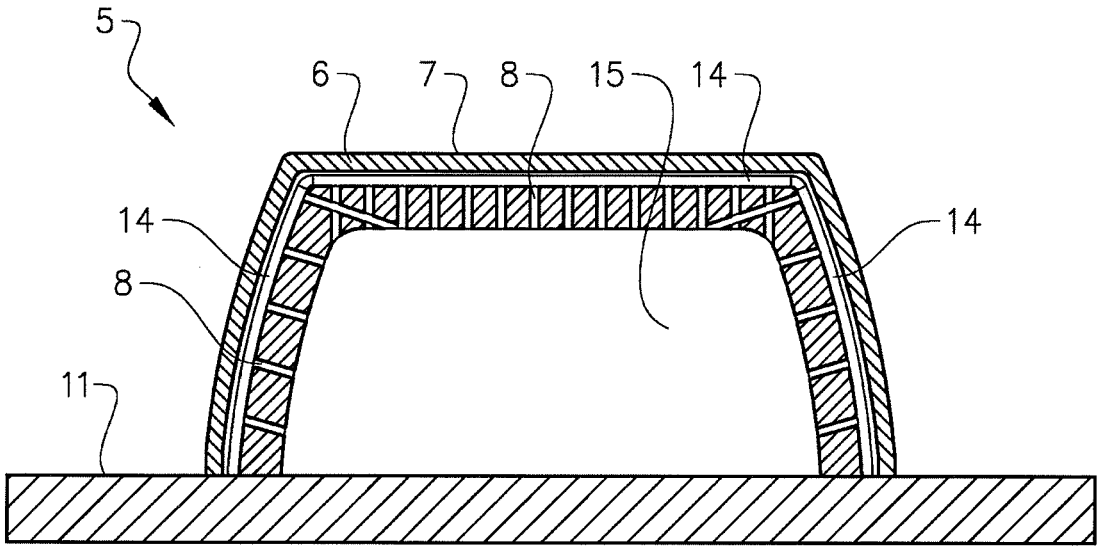
FIG. 3(*a*) shows a cross sectional view through the male mold half shown in FIG. 2.
Figure 3B:
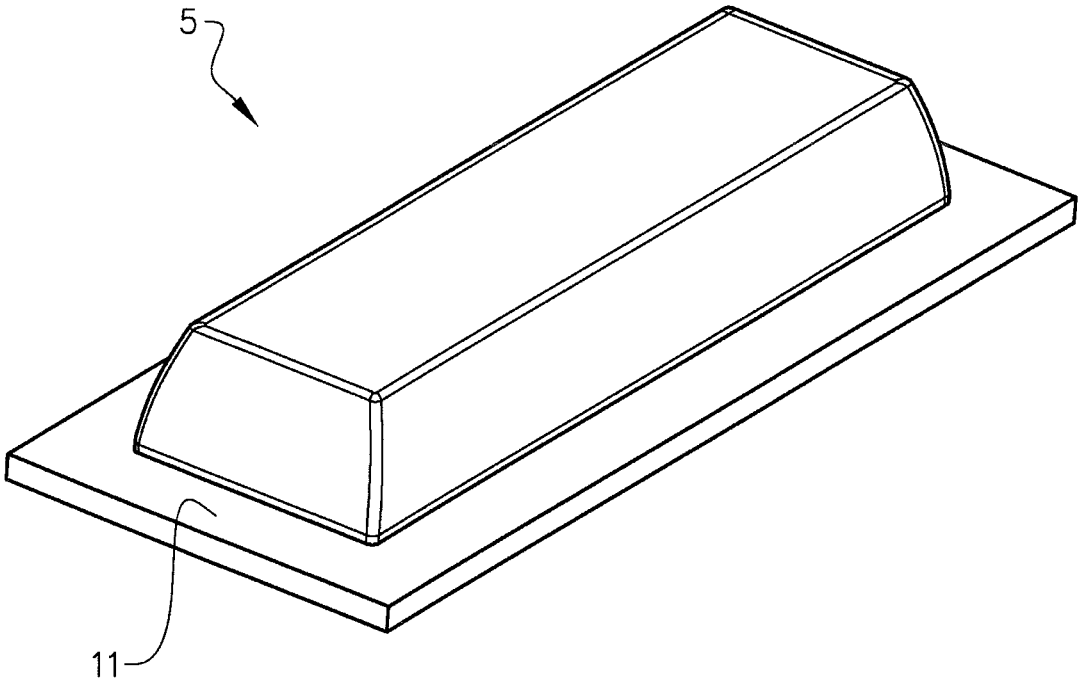
Figure 4A:
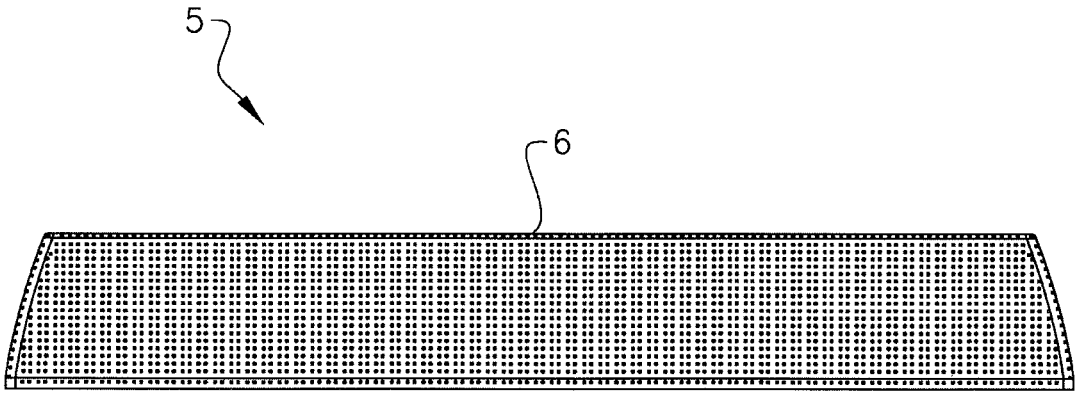
FIGS. 4(*a*)-(*e*) show the male mold half in various views without its covering wire mesh.
Figure 4B:
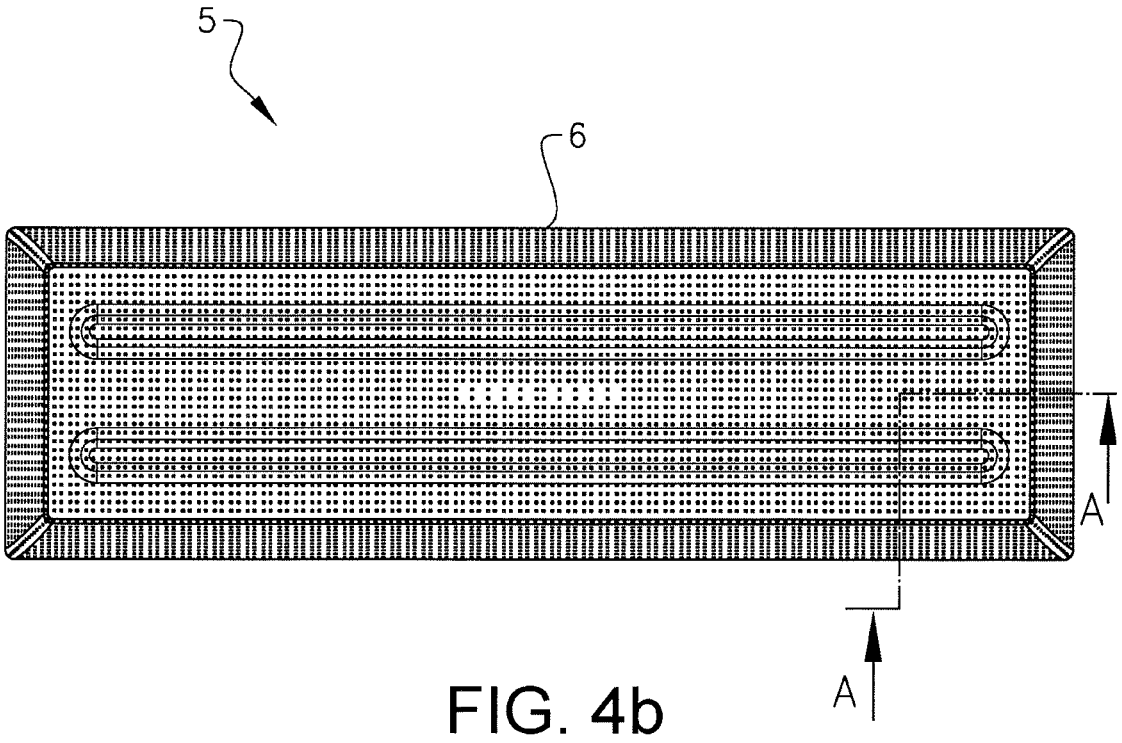
Figure 4C:
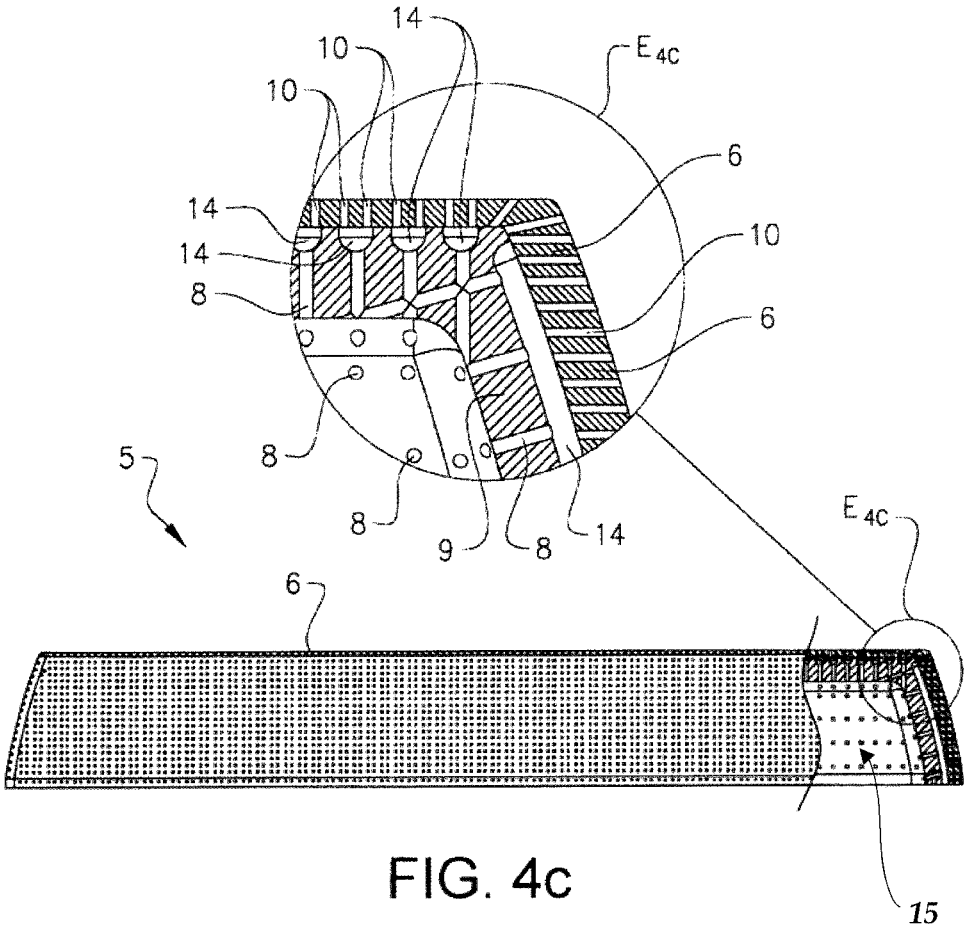
Figure 4D:
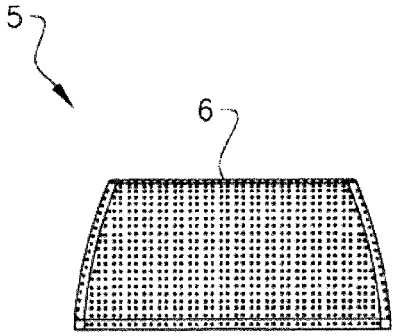
Figure 4E:
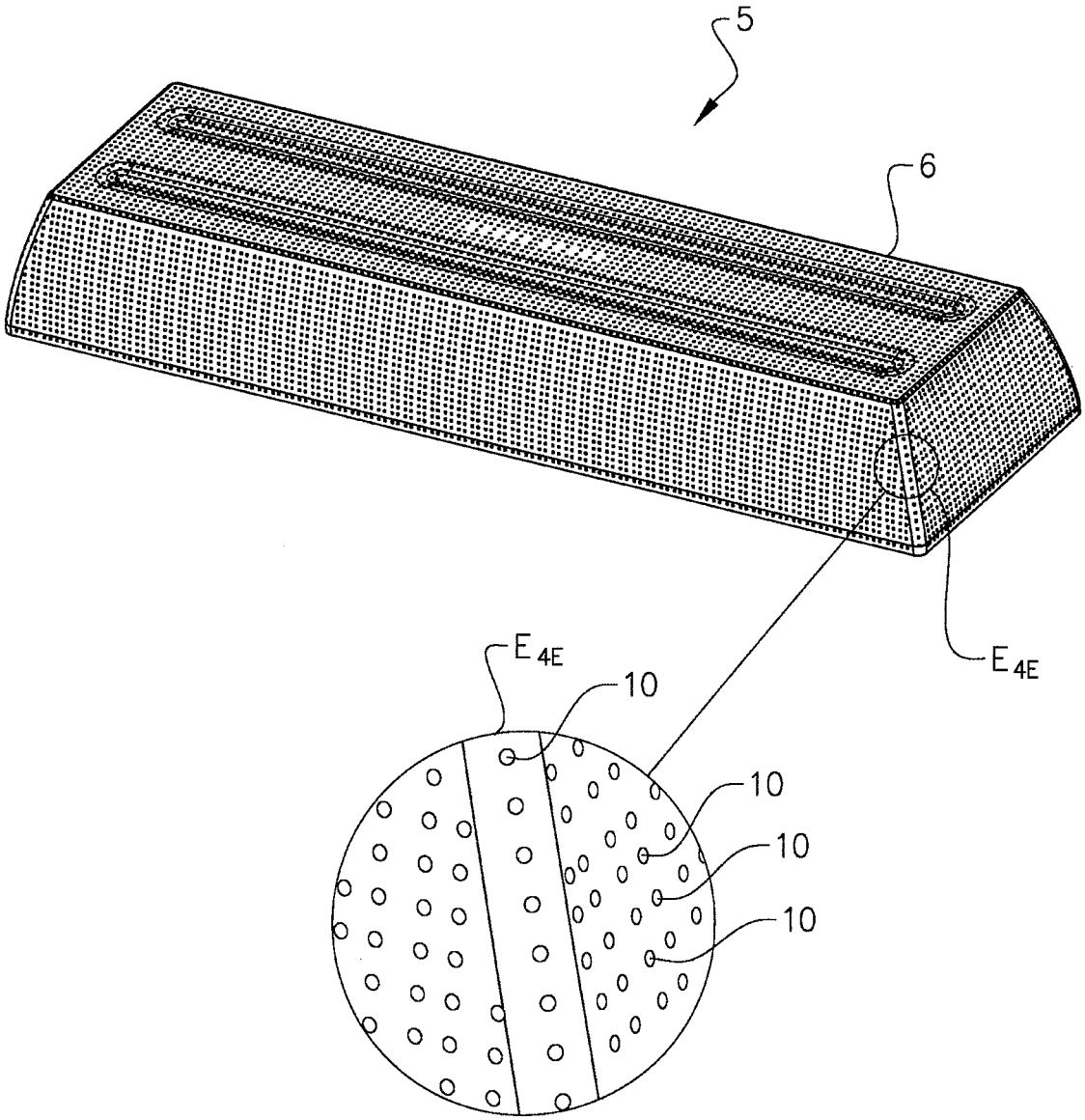

FIG. 3(*a*) shows the male mold half 5 in cross section and the FIG. 3(*b*) shows it in perspective view. In FIGS. 3(*a*) and 3(*b*) the male mold half 5 is shown complete, i.e. covered with the elastomer layer 6 and the wire mesh 7. The surface of said first half mold (5) may in embodiments be covered by being spray coated or cast with an elastomeric material.

Embodiments of the male mold half 5 is made of hollow aluminum and is coated with an elastomer 6 which is ca 30 mm thick. According to a preferred embodiment this elastomer is sprayed onto the aluminum male mold half 5. It is also possible to cast the elastomer onto the aluminum mold half. A typical elastomer should be hydrophobic but not be subject to hydrolysis. An advantageous hardness, particularly for a sprayed on elastomer is 70 A-Shore, to provide optimal elastic properties. 5 mm diameter through-holes spaced 15 mm from each other cover the elastomer layer and connect to through-holes 8 in the aluminum body 9 of the male mold half 5. Within the male mold half there is generated a vacuum of 0.8-0.9 bar. On top of the elastomer layer there is a wire mesh 7. In this case it is a 100 mesh (i.e. 100 threads per inch) and is approximately 1 mm thick. The wire mesh can also be laid in multiple layers which will further contribute to distributing the vacuum forces is more evenly.

The female mold-half 3, as shown in FIG. 1(*f*), is made of aluminum and has in this example a weight of 700 kg. It is heated to ca. 200 degrees C., for example by means of heating rods inserted in holes 13, as shown in FIG. 2, in the material of the female mold-half 3. This is the most energy effective method of heating the female mold-half. Its inner surface 3*a*, as shown in FIG. 1(*f*), will create the outer surface of the product. The two mold halves 3 and 5 can be made of porous aluminum to increase strength over using sintered material and to increase heat conductivity.

FIGS. 4(*a*)-(*e*) show the male mold half 5 in side elevation, top view, longitudinal section (with enlarged detail), end elevation and perspective (with enlarged detail) respectively. In these views the male mold half 5 is shown without its covering wire mesh but with its elastomer layer. As can be seen well in the enlargement E4*e*, the entire elastomer surface is covered with small dewatering through holes 10 all over the surface. As can be seen in the detail E4*c* each of these holes 10 leads to a through 14 in the aluminum body of the male mold half 5, and from there via the holes 8 to the inner vacuum cavity 15 in the male mold half 5. The holes 8 are of larger diameter than the more numerous holes 10 in the elastomer layer 6 thus improving the vacuum effect dewatering the pulp. The male mold half is in embodiments provided with troughs 14 in the body of the male mold half under the elastomer material 6. The troughs 14 are communicating between small dewatering holes 10 in the elastomer layer and holes 8, leading to a vacuum cavity 15 spaced in the bottoms of the troughs 14, for distributing vacuum effect under the elastomeric material 6.

The male mold-half 5 after being dipped in the slurry bath 16, as shown in FIG. 1(*a*), dewaters the slurry through vacuum to approximately 20% dryness (80% water) and the male mold-half 5 is then pressed into the female mold-half 3 down to a gap of ca. 1 mm between the two mold halves. It can vary for this particular product between ca. 0.8 and ca. 1.2 mm without detrimental effects. Due to absorbing heat from the female mold-half 3 (pre-heated to ca. 200° C.), the aluminum male mold-half 5 (initially ca. 25° C.) expands over its length approximately 7-8 mm with corresponding expansions in its width (2.5 mm) and height (1.5 mm). This is compensated for by the elastomer layer 6. The temperature of the hot female mold-half 3 will in turn drop ca. 13 degrees C. during the compression process. The temperatures in both the female and male mold-halves will vary up and down during the compression process thus repeatedly changing slightly the dimensions on the molds. In conventional pulp molding processes, these dimensional variations would cause stresses and unevenness in the finished product, possibly even ruptures. In this particular exemplary product, without an elastomer layer, the temperature of the female mold-half must be rather precise, i.e. in this example between ca. 195° and 204° C. This precision is difficult to achieve and maintain in an industrial process of this type. These problems have been experienced even in the manufacture of relatively small pulp molded products, and require precise adjustment of the temperature to avoid them. Most pulp molded products, such as egg cartons, are several millimeters thick and are thus more porous and it makes no difference whether such products have a rough surface. A product with a rough surface cannot be used in many applications. For a large product, the problems of dimensional heat expansion/contraction will be greatly increased. These problems have hitherto made it impossible to manufacture large pulp molded products with reasonable reject rates and with a smooth surface.

Embodiments herein was developed in order to produce shells for caskets with very few rejects and no necessity of precisely monitoring and continually adjusting the temperatures of the two mold-halves. Since the elastomer is used to absorb much of the dimensional variation of the male and female mold-halves, they can be made much lighter and thinner than otherwise since they will not require a large mass to prevent temperature variations. For instance in this example the female mold-half weighs ca. 750 kg. If it had to maintain a more constant temperature it might have to have a mass of several tons, requiring more energy to heat such a large mass and maintain the heat.

A casket has in general curved sides, something which is expensive to produce in plywood or with wood planks. According to embodiments herein it is possible to produce shells of ca. 1-2 mm in thickness, which provides the maximum stiffness. Thicknesses greater or less than this thickness (1-2 mm) provide less stiffness. It is also possible to fit multiple finished shells inside one another to provide multi-ply strength.

These problems are solved by covering or coating the surface of the male mold-half with an elastomeric material, onto which the wire mesh or meshes is/are then applied. This elastomeric material continually compensates for the varying dimensions of the two mold-halves during the compression/heating process.

By virtue of embodiments herein there is a larger operating window for the process. The design according to embodiments herein is much more forgiving. For example, the compression and drying of the wet pulp will cool off the mold-halves, with accompanying dimensional changes.

According to one embodiment of embodiments herein the elastomer is sprayed onto the surface of the male mold half, but a more complicated casting process is also possible whereby the elastomer is cast onto the male mold half 5.

It is also advantageous to mount the stationary mold half (in this case the female mold half 3) to be slightly horizontally moveable (+−25 mm) to make sure that any heating expansion will not prevent a correct horizontal alignment between the male 5 and female 3 mold halves during the pressing operation. In embodiments of an apparatus for use together with a pair of mold halves as described herein a second mold half is mounted for slight horizontal movement of at most 25 mm, to achieve correct alignment during fitting compression of a first mold half 5 in the second mold half 3.

It is also advantageous to equip the pulp molding apparatus 1 with mechanical jacks, combined with a more incremental final stage for the compression step. This final stage can also be accomplished with the aid of hydraulic pistons.

The invention claimed is:

1. A pair of metal mold halves suitable for pulp molding by compression and heating, comprising:

a first metal mold half for application of a pulp slurry, said first metal mold half having a metal surface and comprising an elastomeric material spray coated or cast on the metal surface; and a second conforming metal mold half.

2. The pair of mold halves according to claim 1, wherein said first metal mold half is a perforated mold half suitable for suction dewatering of pulp.

3. The pair of mold halves according to claim 2, wherein one or several layers of wire mesh cover the elastomeric material providing a suction dewatering surface for pulp.

4. The pair of mold halves according to claim 1, wherein said first metal mold half is a male mold half and said second conforming metal mold half is a female mold half conforming to said male mold half.

5. The pair of mold halves according to claim 4, wherein said male mold half has a hollow interior vacuum cavity and multiple conduit pathways providing suction effect between said vacuum cavity and surface of said male mold half for suction dewatering of pulp.

6. The pair of mold halves according to claim 5, wherein said male mold half is provided under said elastomer material with troughs in said body of said male mold half communicating between dewatering holes in the elastomer layer and holes, leading to a vacuum cavity spaced in the bottoms of the troughs, for distributing vacuum effect under said elastomeric material.

7. The pair of mold halves according to claim 1 said elastomeric material has a thickness of between 10 and 50 mm.

8. The pair of mold halves according to claim 1, wherein said elastomeric material has a hardness of about 60-80 Shore A.

9. The pair of mold halves according to claim 1, wherein said elastomeric material has a different hardness on the sides of the mold half than on the bottom thereof.

10. The apparatus for use together with the pair of mold halves according to claim 1, comprising, a frame in which a first of said mold halves is mounted in means for translational movement towards a second mold half, means for compressing and holding said pair of mold halves fitted against each other and a bath of pulp slurry, wherein said means for translational movement are adapted for immersing a first mold half in said bath of pulp slurry and moving said first mold half into fitting compression against said second mold half.

11. The apparatus according to claim 10, wherein said second mold half is mounted for slight horizontal movement of at most 25 mm, to achieve correct alignment during fitting compression of said first mold half in said second mold half.

* * * * *